US010582599B2

(12) United States Patent
Hong et al.

(10) Patent No.: US 10,582,599 B2
(45) Date of Patent: Mar. 3, 2020

(54) REMOTE CONTROLLER, LIGHTING DEVICE AND LIGHTING SYSTEM

(71) Applicant: OPPLE LIGHTING CO., LTD., Shanghai (CN)

(72) Inventors: Mantang Hong, Shanghai (CN); Jianguo Li, Shanghai (CN)

(73) Assignee: OPPLE LIGHTING CO., LTD., Shanghai (CN)

( * ) Notice: Subject to any disclaimer, the term of this patent is extended or adjusted under 35 U.S.C. 154(b) by 0 days.

(21) Appl. No.: 16/235,861

(22) Filed: Dec. 28, 2018

(65) Prior Publication Data

US 2019/0141821 A1 May 9, 2019

Related U.S. Application Data

(63) Continuation of application No. PCT/CN2017/087477, filed on Jun. 7, 2017.

(51) Int. Cl.
*H05B 45/00* (2020.01)
*H05B 47/00* (2020.01)
(Continued)

(52) U.S. Cl.
CPC ..... *H05B 47/19* (2020.01); *F21S 10/023* (2013.01); *F21S 10/04* (2013.01); *F21V 15/012* (2013.01);
(Continued)

(58) Field of Classification Search
CPC ..... H05B 37/02; H05B 33/08; H05B 45/00; H05B 45/20; H05B 47/00; H05B 47/19;
(Continued)

(56) References Cited

U.S. PATENT DOCUMENTS 8,963,432 B2 * 2/2015 Ishikita ..... H05B 37/0227 315/129
2010/0045205 A1 * 2/2010 Bergman ..... H05B 37/0272 315/294

FOREIGN PATENT DOCUMENTS

CN 201487754 U 5/2010
CN 203027529 U 6/2013
(Continued)

OTHER PUBLICATIONS

International Search Report (including English translation) and Written Opinion issued in PCT/CN2017/087477, dated Sep. 8, 2017, 12 pages.

*Primary Examiner* — Jimmy T Vu
(74) *Attorney, Agent, or Firm* — Arch & Lake LLP

(57) ABSTRACT

The present disclosure provides a remote controller, a lighting device and a lighting system. The remote controller is configured for controlling color of light emitted by a target lighting device and includes: a housing; a main control panel of a remote control terminal, located in the housing and provided with a color acquiring circuit for acquiring color information of a target region, and a wireless transmitter for transmitting the color information to the target lighting device; a color acquiring switch, located on the housing and electrically connected with both the color acquiring circuit and the wireless transmitter, and the color acquiring switch being configured for turning on/off the color acquiring circuit and the wireless transmitter. The remote controller has a simple structure and convenient operation, so that the color of the light emitted by the lighting device may be freely adjusted according to individual needs, which is convenient.

24 Claims, 15 Drawing Sheets

(51) Int. Cl.

| | |
|---|---|
| ***F21S 10/04*** | (2006.01) |
| ***H05B 47/19*** | (2020.01) |
| ***H05B 45/20*** | (2020.01) |
| ***F21S 10/02*** | (2006.01) |
| ***F21V 15/01*** | (2006.01) |
| *F21Y 115/10* | (2016.01) |
| *F21V 17/10* | (2006.01) |

(52) U.S. Cl.
CPC ..... *H05B 45/20* (2020.01); *F21V 17/10* (2013.01); *F21Y 2115/10* (2016.08)

(58) Field of Classification Search
CPC ..... F21S 10/023; F21S 10/04; F21S 15/012; F21Y 2115/10; F21V 17/10
See application file for complete search history.

(56) References Cited

FOREIGN PATENT DOCUMENTS

| | | | |
|---|---|---|---|
| CN | 204202750 | U | 3/2015 |
| CN | 204943358 | U | 1/2016 |
| CN | 106304529 | A | 1/2017 |
| CN | 106304530 | A | 1/2017 |
| CN | 205883636 | U | 1/2017 |
| CN | 205938645 | U | 2/2017 |

* cited by examiner

REMOTE CONTROLLER, LIGHTING DEVICE AND LIGHTING SYSTEM

CROSS-REFERENCE TO RELATED APPLICATIONS

This application is based upon and claims the priority of PCT patent application No. PCT/CN2017/087477 filed on Jun. 7, 2017 which claims the priority of Chinese Patent Application No. 201620679131.1 filed on Jun. 30, 2016 and Chinese Patent Application No. 201620680433.0 filed on Jun. 30, 2016, the entire contents of which are hereby incorporated by reference herein.

TECHNICAL FIELD

The present disclosure relates to a field of lighting technology, and particularly, to a remote controller, a lighting device and a lighting system

BACKGROUND

With continuous development of lighting technology, color lamps capable of emitting light of different colors are widely used gradually, and how to adjust colors of these color lamps, so as to make the color of the light emitted by the lamp match lighting environment or meet requirements of a user, is gradually gaining attention in the industry.

At present, a remote controller is often configured for controlling color of light emitted by a color lamp, and however, existing remote controller is often pre-recorded several commonly-used colors in production process, and these commonly-used colors are difficult to match the lighting environment of various colors in reality, so that an operator may not use the remote controller to adjust the color of the light emitted by the color lamp according to the color of the lighting environment, resulting in the color of the light emitted by the color lamp being monotonous, and seriously, light pollution may be caused by conflict between the colors of the light emitted by the lamp and the lighting environment, endangering health of the user.

SUMMARY

The present disclosure provides a remote controller, a lighting device and a lighting system, especially a remote controller for a lighting device, to solve a problem that a traditional remote controller may only control a lighting device to emit light of several fixed colors.

The present disclosure provides a remote controller for controlling color of light emitted by a target lighting device, comprising: a housing; a main control panel of a remote control terminal, located in the housing and provided with a color acquiring circuit for acquiring color information of a target region and a wireless transmitter for transmitting the color information to the target lighting device; and a color acquiring switch, located on the housing and electrically connected with both the color acquiring circuit and the wireless transmitter, and the color acquiring switch being configured for turning on/off the color acquiring circuit and the wireless transmitter.

The present disclosure further provides a lighting device, comprising: a lamp shell; a light source assembly, arranged in the lamp shell and configured for emitting light; a driving assembly, electrically connected with the light source assembly; wherein the lighting device is controlled by any one of the remote controllers described above, to control color of light emitted by the light source assembly.

The present disclosure further provides a lighting system, comprising: any one of the remote controllers described above, configured for acquiring color information of a target region and transmitting the color information to a lighting device; and any one of the lighting devices described above, configured for controlling color of light emitted by a light source assembly in accordance with the color information.

The remote controller according to the present disclosure has a simple structure and convenient operation, so that the color of the light emitted by the lighting device may be freely adjusted according to individual needs, which is convenient.

The above description is only an overview of the technical solutions of the present disclosure, in order to more clearly understand the technical means of the present disclosure, it may be implemented according to content of the specification, and in order to make the above-described and other objects, features and advantages of the present disclosure be more clearly understood, specific embodiments of the invention are illustrated, hereinafter.

Figure 1:
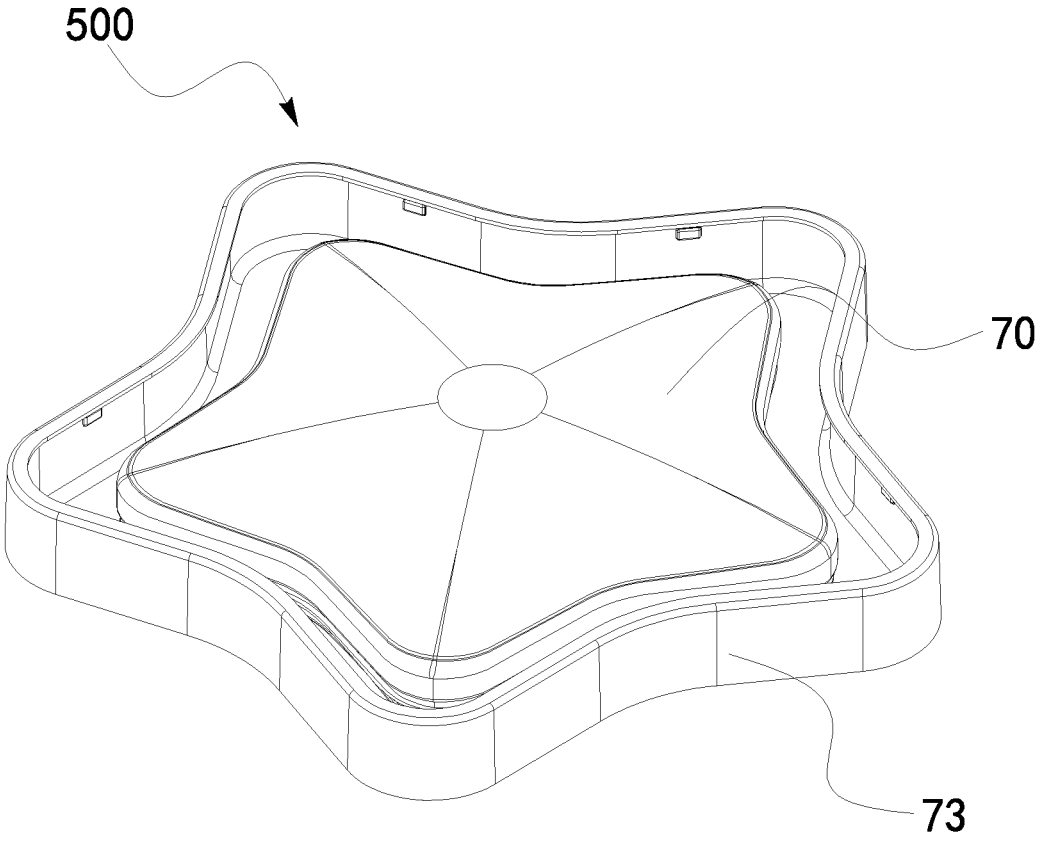
FIG. 1 is a schematic diagram of a lighting device in one direction in accordance with an example of the present disclosure.
Figure 2:
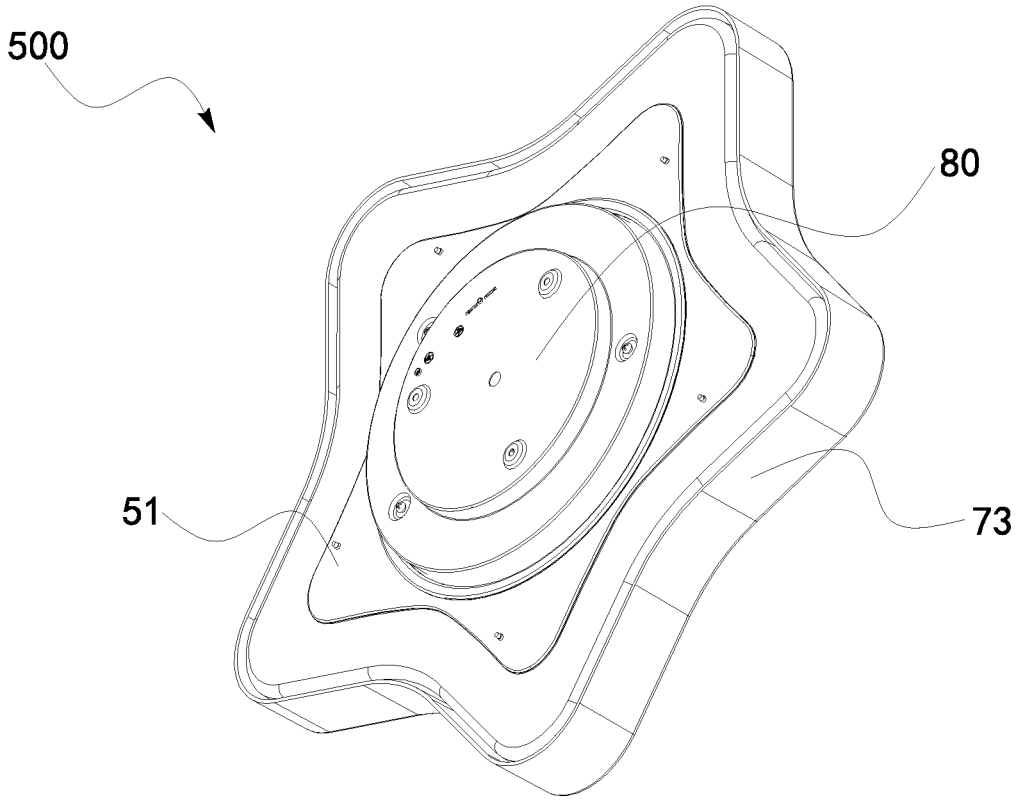
FIG. 2 is a schematic diagram of a lighting device in another direction in accordance with an example of the present disclosure.
Figure 3:
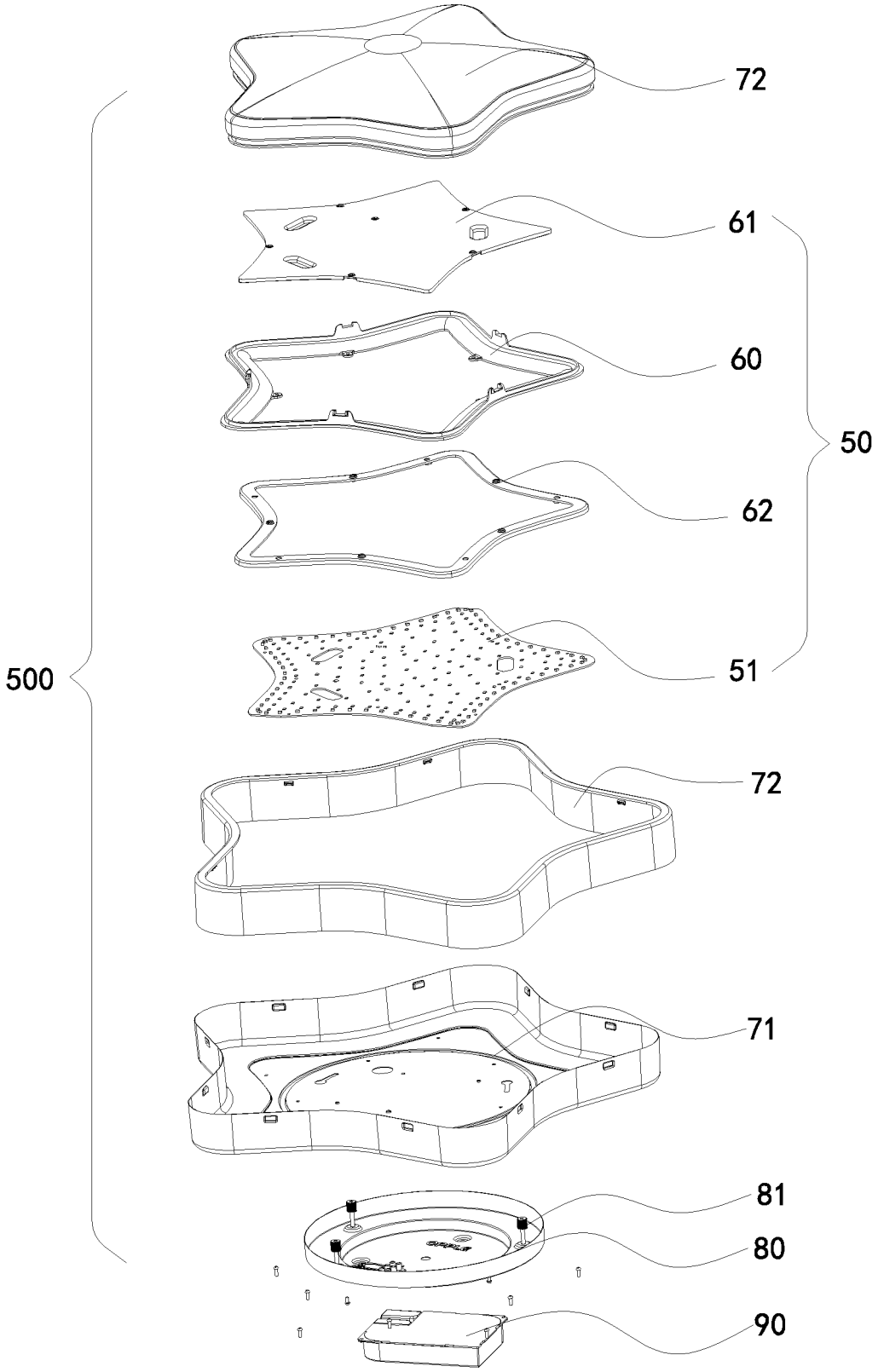
FIG. 3 is an exploded view of a lighting device in accordance with an example of the present disclosure.
Figure 4:
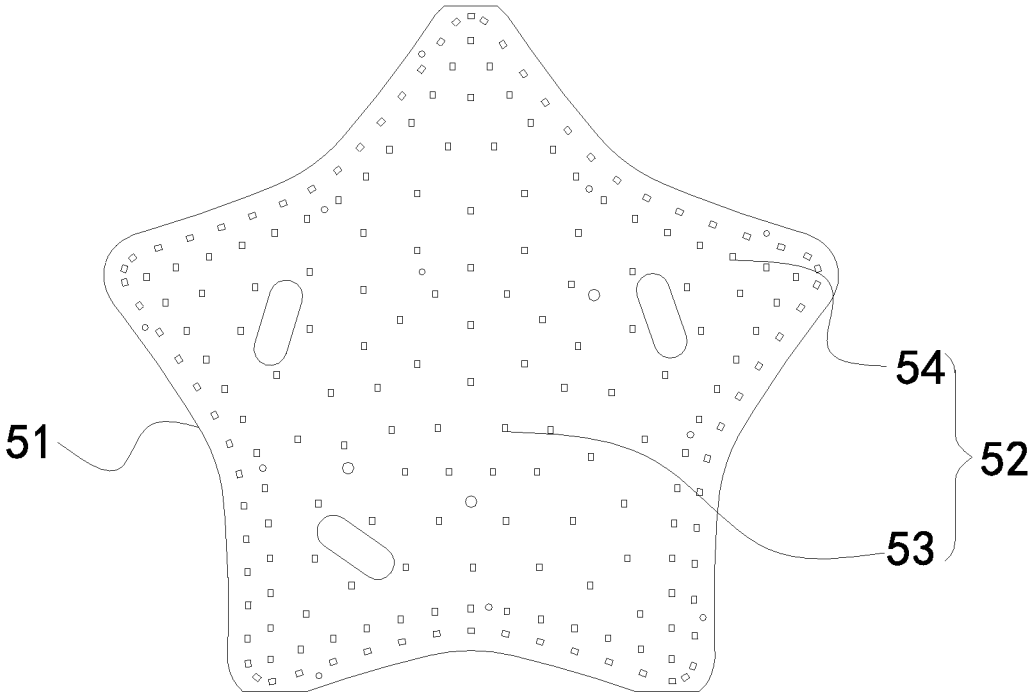
FIG. 4 is a schematic diagram of a light source assembly of a lighting device in accordance with an example of the present disclosure.
Figure 5:
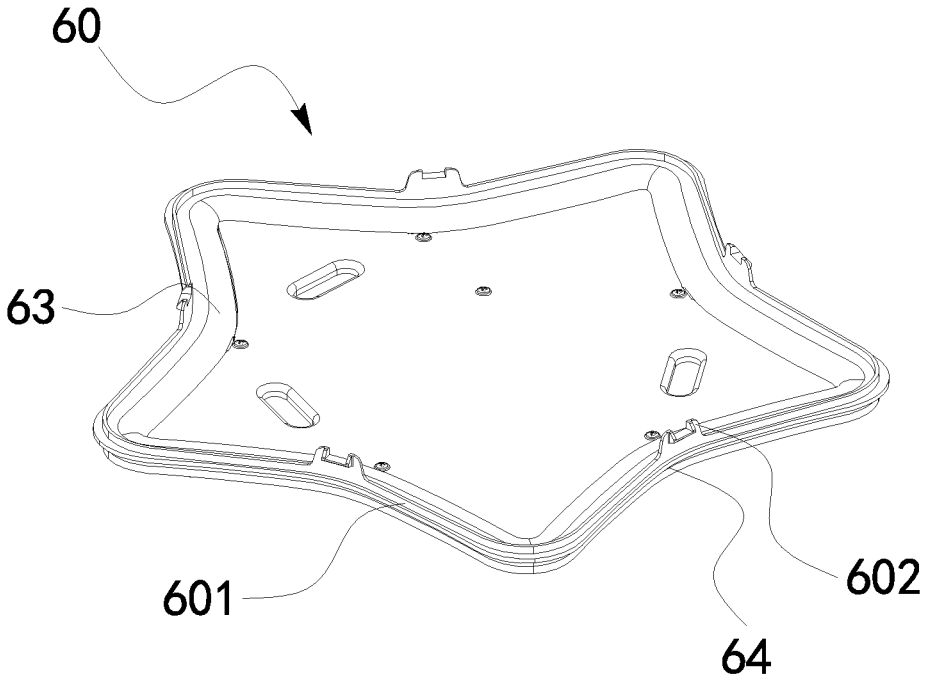
FIG. 5 is a schematic diagram of an isolating cover of a lighting device in accordance with an example of the present disclosure.
Figure 6:
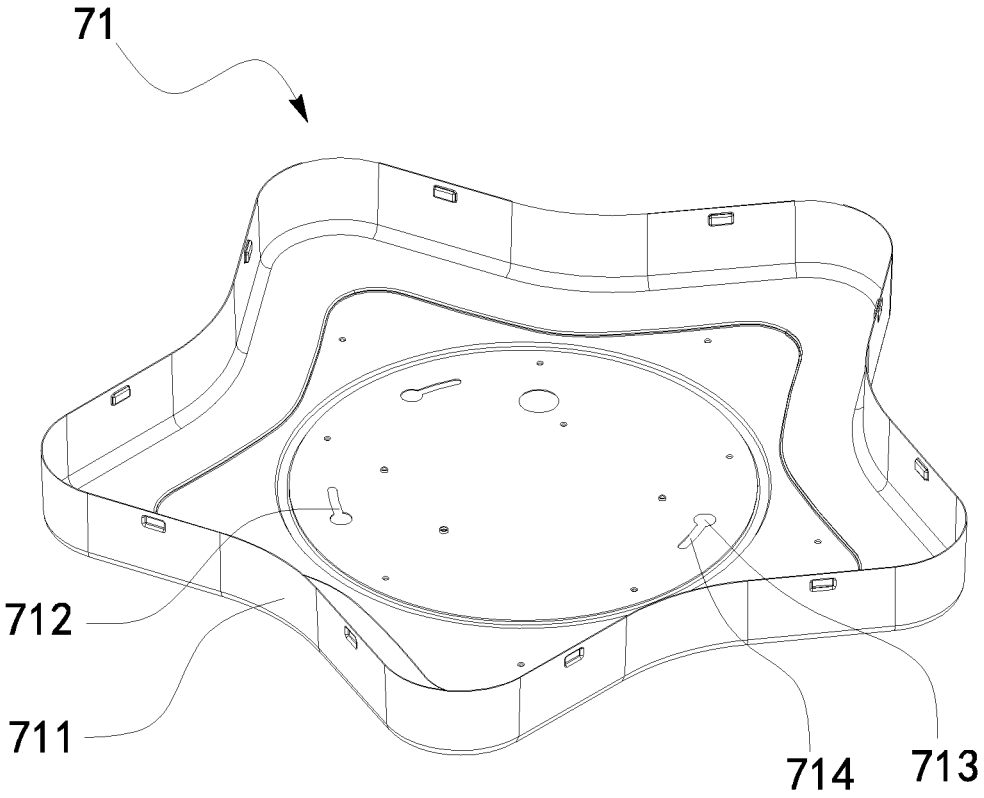
FIG. 6 is a schematic diagram of a chassis of a lighting device in accordance with an example of the present disclosure.
Figure 7:
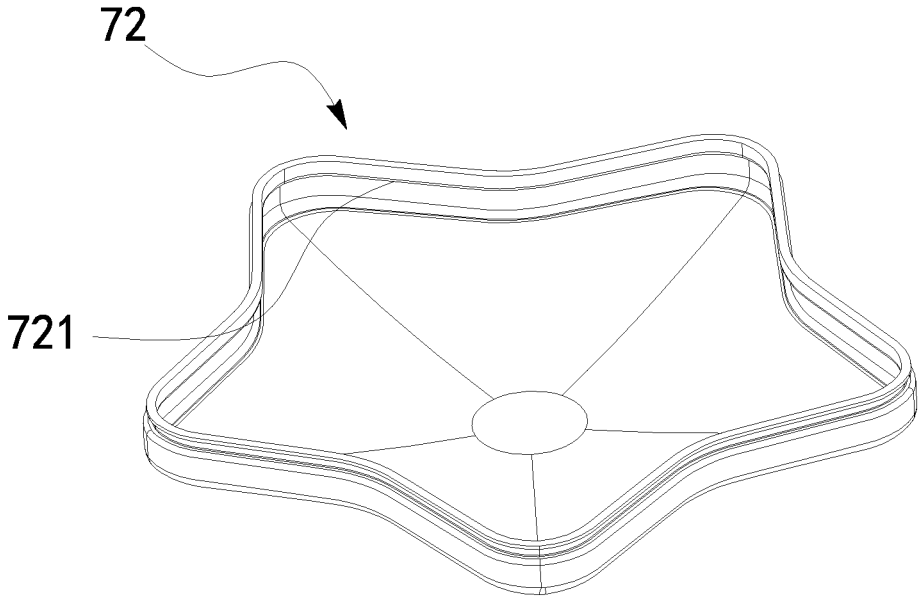
FIG. 7 is a schematic diagram of a mask of a lighting device in accordance with an example of the present disclosure.
Figure 8:
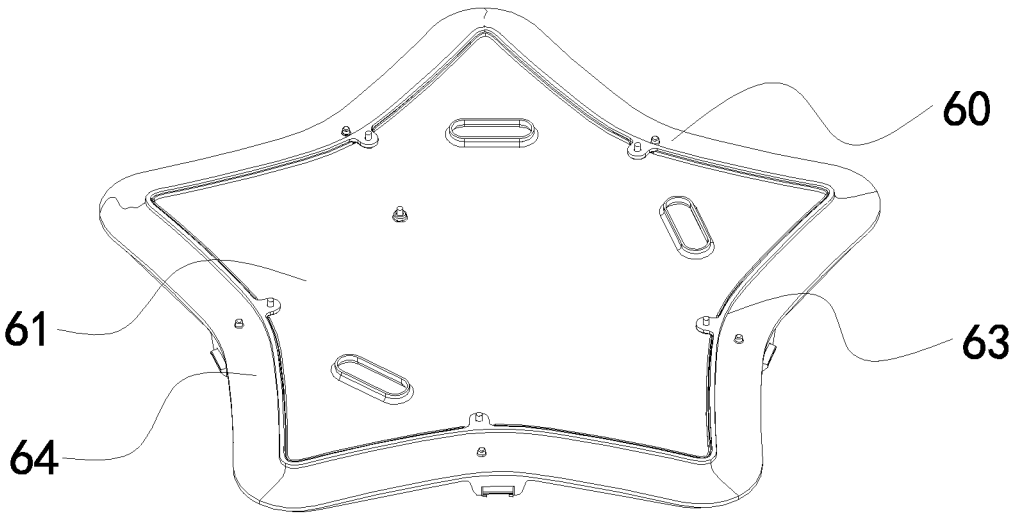
FIG. 8 is a schematic diagram of a combining state of an isolating cover and a white light protective cover of a lighting device in accordance with an example of the present disclosure.
Figure 9:
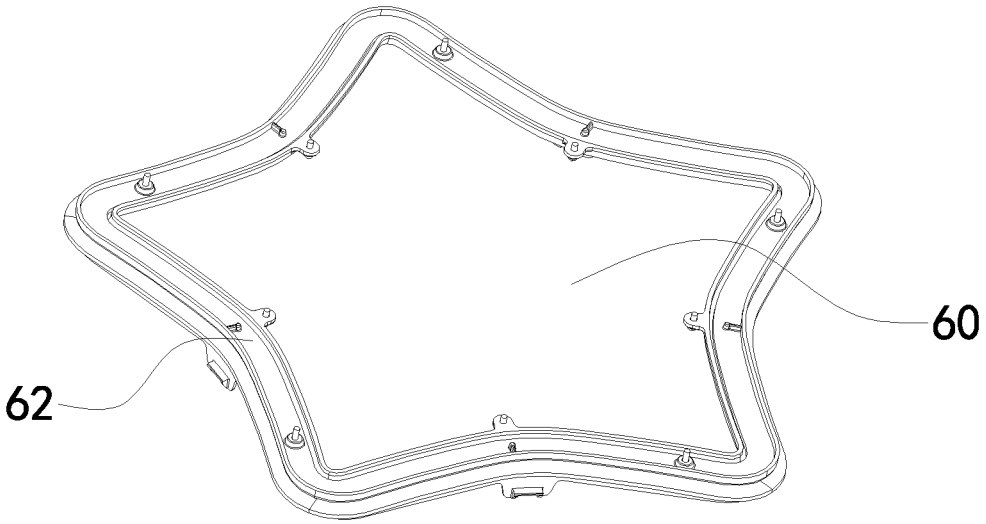
FIG. 9 is a schematic diagram showing a combining state of an isolating cover and a colored light protective cover of a lighting device in accordance with an example of the present disclosure.
Figure 10:
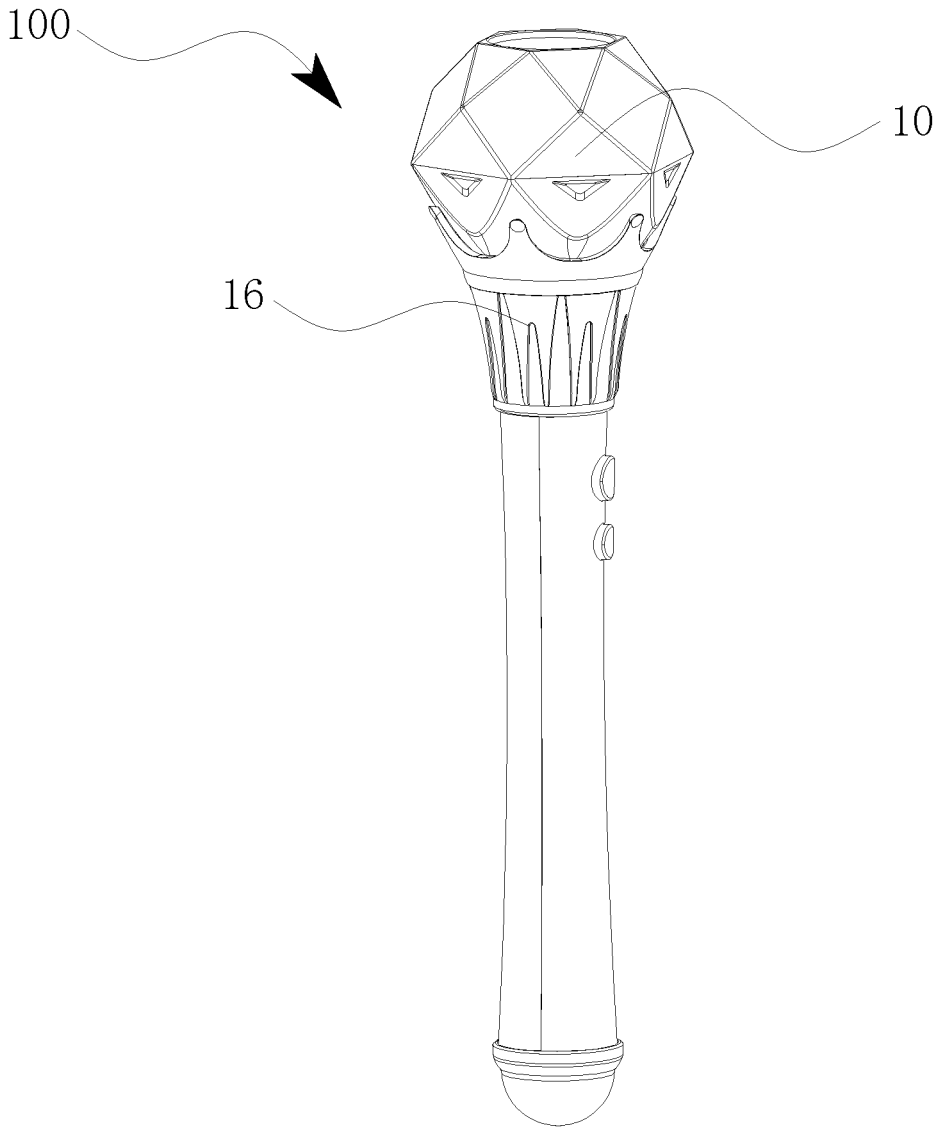
FIG. 10 is a schematic diagram of a remote controller in accordance with an example of the present disclosure.
Figure 11:
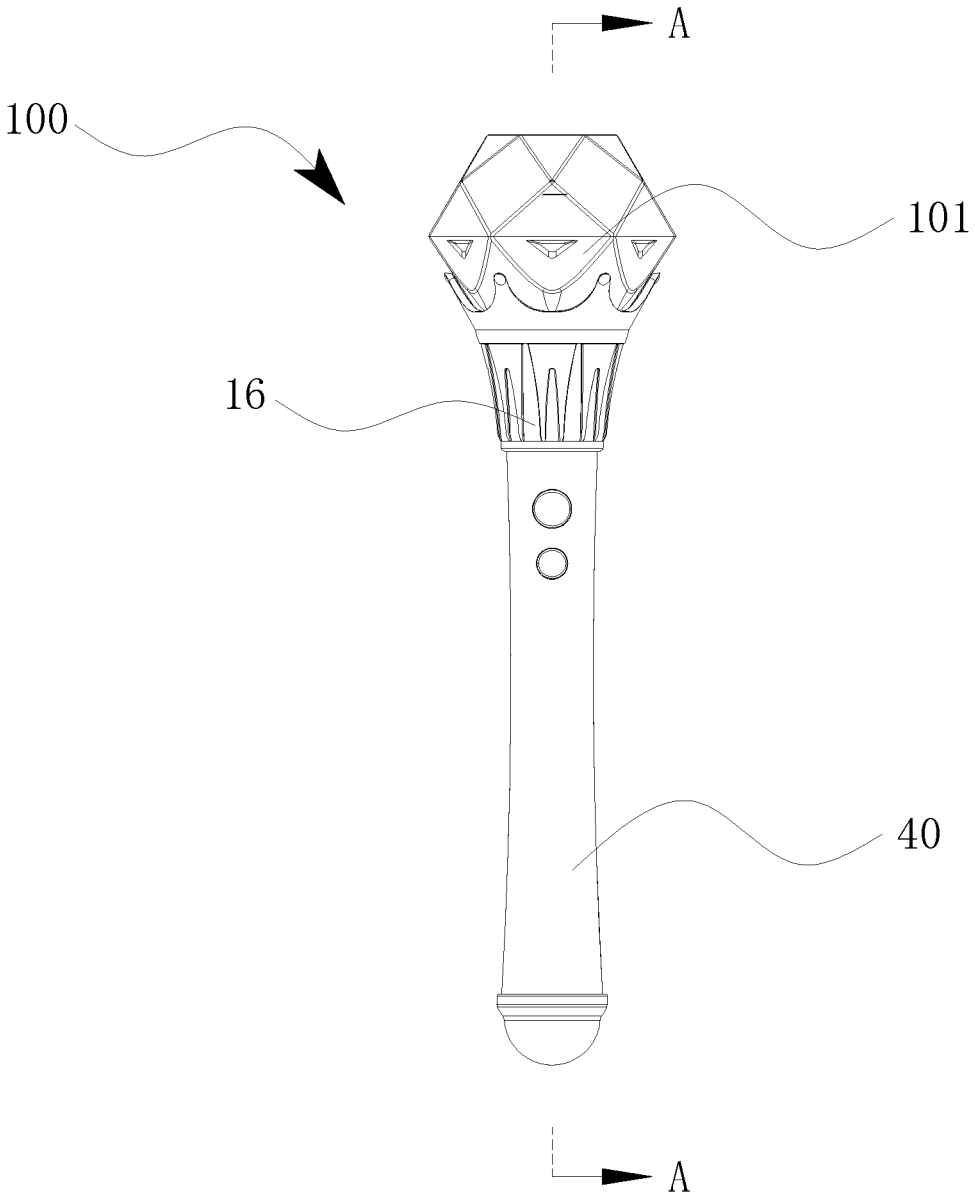
FIG. 11 is a front view of a remote controller in accordance with an example of the present disclosure.
Figure 12:
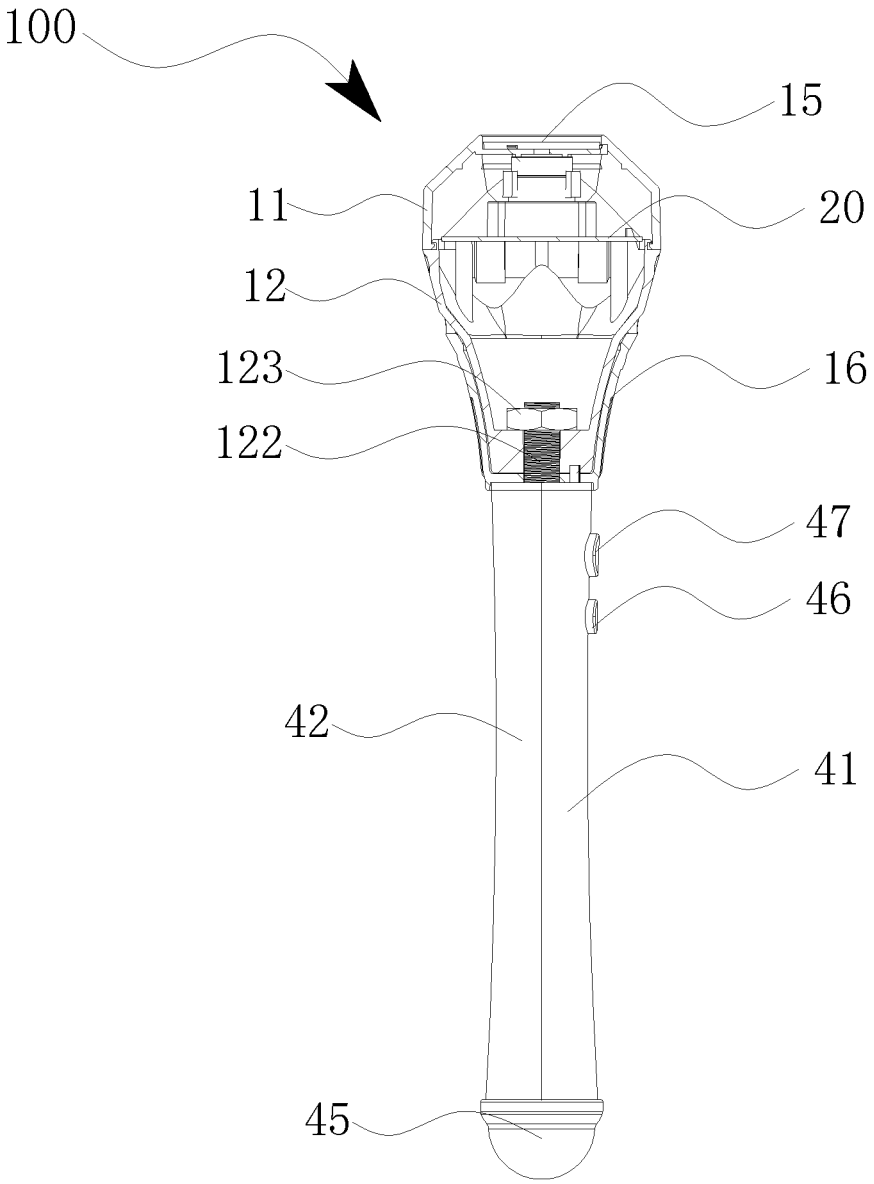
FIG. 12 is a cross-sectional view of a remote controller in an A-A direction in accordance with an example of the present disclosure.
Figure 13:
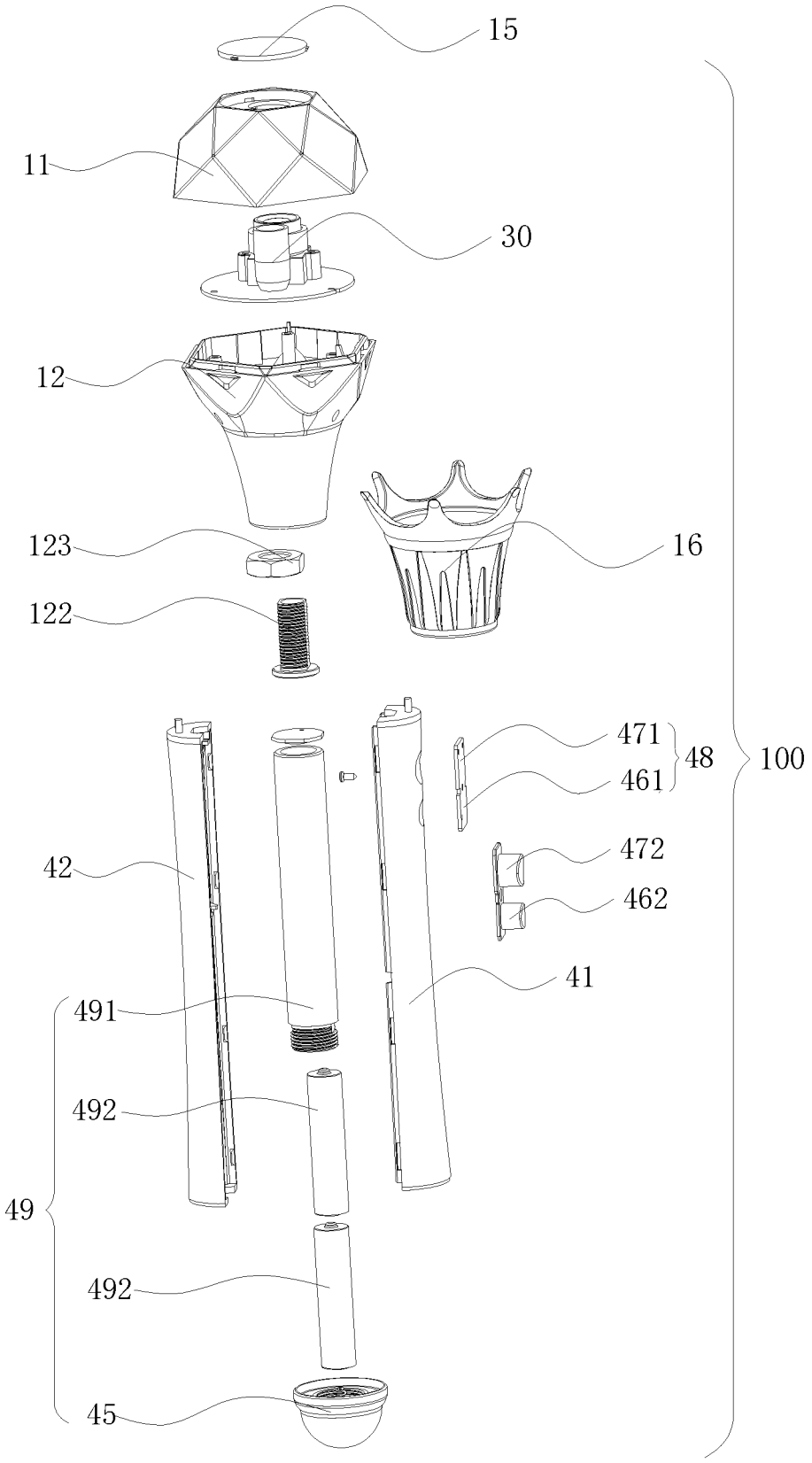
FIG. 13 is an exploded view of a remote controller in accordance with an example of the present disclosure.

Reference signs: remote controller 100, housing 10, head shell 101, upper cover 11, buckle 111, groove 112, lower cover 12, buckle mouth 121, fixed screw 122, light compensating through hole 13, color acquiring through hole 14, light-transmitting lens 15, ornament 16, main control panel of remote control terminal 20, color acquiring circuit 30, sensing element 31, light compensating element 32, clasp 321, condensing lens 33, holding rod 40, front cover 41, rear cover 42, switch storage cavity 43, power storage cavity 44, cover 45, pairing switch 46, pairing circuit board 461, pairing button cap 462, circuit board of switch part 48, color acquiring switch 47, color acquiring circuit board 471, color acquiring button cap 472, driving power assembly 49, battery box 491, battery 492, lighting device 500, light source assembly 50, light source plate 51, light emitting unit set 52, first color light emitting unit 53, second color light emitting unit 54, isolating cover 60, protrusion 601, buckle 602, first protective cover 61, second protective cover 62, isolation connecting part 63, light distributing part 64, lamp shell 70, chassis 71, chassis rim 711, screw mounting hole 712, mounting section 713, locking section 714, mask 72, positioning clasp 721, protective frame 73, mounting hanging plate 80, screw 81, driving assembly 90.

DETAILED DESCRIPTION

Hereinafter, implementation modes of the present disclosure are described in detail, and examples of the implementation modes are illustrated in the drawings, where the same or similar elements, or elements having the same or similar functions are indicated by the same or similar reference signs. The embodiments described with reference to the drawings are exemplarily, and intended to illustrate the invention and are not to be construed as limitation to the invention.

The present disclosure provides a remote controller 100 and a lighting device 500 controlled by the remote controller 100. Referring to FIGS. 1 to 18:

A light source assembly 50 comprises: a light source plate 51; a light emitting unit set 52, the light emitting unit set 52 comprises a first color light emitting unit 53 and a second color light emitting unit 54 which are arranged on the light source plate 51; a main control panel of a lighting terminal, electrically connected with the light source plate 51 and configured for controlling the first color light emitting unit 53 and/or the second color light emitting unit 54 to emit light, and a wireless communication module is arranged on the main control panel; an isolating cover 60, the isolating cover 60 is located between the first color light emitting unit 53 and the second color light emitting unit 54 and configured for separating the first color light emitting unit 53 and the second color light emitting unit 54 in different optical cavities. The first color light emitting unit 53 and the second color light emitting unit 54 are integrated on one light source plate 51, so that the light source assembly 50 has a simple and compact structure, and may emit light of a first color and light of a second color. The isolating cover 60 separates the first color light emitting unit 53 and the second color light emitting unit 54 in different cavities, for example, a first cavity for accommodating the first color light emitting unit 53 and a second cavity for accommodating the second color light emitting unit 54, respectively. While the first color light emitting unit 53 and the second color light emitting unit 54 emit light, there is no interference. The main control panel of the lighting terminal is configured to control the first color light emitting unit 53 and/or the second color light emitting unit 54 to emit light, the two lights may be emitted simultaneously or separately; a wireless communication module is arranged on the main control panel of the lighting terminal and configured for receiving a wireless signal, including turning on, turning off, pairing with a remote control device of the light source assembly 50, receiving color information, adjusting brightness of light and the like. The main control panel of the lighting terminal and the light source plate 51 may be integrated into an integral structure, or a disassemble structure. The first cavity is provided with a first protective cover 61, and the second cavity is provided with a second protective cover 62; the first protective cover 61 protects the first color light emitting unit 53, and the second protective cover 62 protects the second color light emitting unit 54, which can prevent dust from falling onto the light source plate 51, effectively protect the light source assembly 50, extending service life of the light source assembly 50, and ensuring light emitting effect of the light source assembly 50 as well. The first protective cover 61 and the second protective cover 62 may be lenses for distributing light or a light uniforming cover for uniforming light. Of course, as another example of the present disclosure, the first color light emitting unit 53 and the second color light emitting unit 54 may be integrated on two light source plates respectively, and then the two light source plates are arranged on a general light source plate.

In order to facilitate receiving the color of the light emitted by the light source assembly 50, the main control panel of the lighting terminal is provided with a receiver; the receiver is configured for receiving color information, which may be a signal sent by the color acquiring terminal, such as a remote controller, a mobile phone, a video camera, etc. and transmitted to the main control panel of the lighting terminal, and the main control panel of the lighting terminal controls the first color light emitting unit 53 and/or the second color light emitting unit 54 to emit light in line with the color information.

The first color light emitting unit 53 is a white light emitting unit, and the second color light emitting unit 54 is a color light emitting unit. The first color light emitting unit 53 is a white light emitting unit, in order to meet general lighting requirement, and the second color light emitting unit 54 is a color light emitting unit, and may be controlled by a control unit of the light source assembly 50 to emit light of different colors, thereby increasing interestingness of illumination, to meet lighting requirements of different groups of people.

The second color light emitting unit 54 is arranged on a periphery of the first color light emitting unit 53, i.e., the colored light emitting unit is arranged in a peripheral region of the light source plate 51; and the first color light emitting unit 53, i.e., the white light emitting unit is arranged inside the peripheral region. When the light source assembly 50 emits light, a middle region emits white light, and a colored aperture is emitted around the white light, and there may be a shadow or no shadow between the color aperture and the white light.

As another example of the present disclosure, the first color light emitting unit 53, i.e., the white light emitting unit is arranged in a peripheral region of the light source plate 51; and the second color light emitting unit 54, i.e., the color light emitting unit is arranged inside the peripheral region. When the light source unit 50 emits light, a middle region emits white light, and a colored aperture is emitted around the white light, and there may be a shadow or no shadow between the color aperture and the white light.

The isolating cover 60 comprises an isolation connecting part 63 connected to the light source plate 51 and a light distributing part 64 connected with the isolation connecting part 63, and the light distributing part 64 is configured for diffusing the colored light emitted by the second color light emitting unit 54 toward the periphery in a way of reflection, or a combination of reflection and refraction, or a combination of reflection and transmission; the isolation connecting part 63 is configured for connecting with the light source plate 51 in a way of screw, or pin, or welding, or buckling connection, etc., and preferably, a screw pair is used in the invention for locking, which are easy to be mounted and disassembled. The light distributing part 64 diffuses the colored light emitted by the second color light emitting unit 54 toward the periphery, thereby avoid the interference between the white light emitted by the first color light emitting unit 53 and the colored light emitted by the second color light emitting unit 54.

The first color light emitting unit 53 is a first color LED light emitting unit, and the second color light emitting unit 54 is a second color LED light emitting unit. The first color LED light emitting unit and the second color LED light emitting unit are energy-saving, not easy to generate heat, and have a long service life.

A lighting device, comprising: a lamp shell 70; a light source assembly 50, arranged in the lamp shell and configured for emitting light. The lamp shell 70 is further provided with a driving assembly 90 for driving the light source assembly 50, and the driving assembly 90 may comprise a driving power unit with reference to other possibilities indicated previously. The driving power unit supplies power to the light source assembly 100, the first color light emitting unit 53 emits white light, and the second color light emitting unit 54 emits colored light under control of the main control panel of the lighting terminal. Specifically, a color acquiring circuit is arranged in a color acquiring terminal, and color information acquired by the color acquiring circuit is calculated and processed by the main control panel of the intelligent color acquiring terminal, and then transmitted to a control unit of the lighting device through a wireless transmitter, and the control unit controls the color of the light emitted by the colored light emitting unit according to the received information data of the color. The intelligent color acquiring terminal may be a mobile phone, a camera, a remote controller and the like. The white light emitting unit and the colored light emitting unit are integrated on the light source plate 51, so that the light source assembly 50 has a simple and compact structure, and may emit white light and colored light, and the white light emitting unit and the colored light emitting unit may be powered to emit light simultaneously or separately, to realize effects of daily lighting and decoration simultaneously or separately, meeting the requirements of different groups of people.

The lamp shell 70 comprises a chassis 71, the light source plate 51 is locked on the chassis 71 by a locking device, the light source plate 51 may be locked on the chassis 71 by screws, the light source plate 51 may be may be attached to the chassis 71 by a magnet, or the light source plate 51 may be adhered to the chassis 71 by a glue, etc.; the lamp shell 70 further comprises a mask 72 covering the light source assembly 50, and the first color light emitting unit 53 and the second color light emitting unit 54 face the mask 72, respectively. The chassis 71 and the mask 72 form the lamp shell 70 to enclose the light source assembly 50. The mask 72 may be a transparent or translucent mask 72, in order to effectively protect the light source assembly 50 of the lighting device 500, prevent dust from falling into the light source assembly 50 to affect lighting effect and service life of the lighting device 500.

A positioning clasp 721 is arranged on an inner wall of the mask 72 in a circumferential direction, the isolating cover 60 is provided with a mounting protrusion 601 corresponding to the mask 72 in a circumferential direction. The buckles 602 are arranged on the mounting protrusion 601 at interval, and the mask 72 and the isolating cover 60 are locked with each other by the buckle 602 and the positioning clasp 721. After the isolating cover 60 is mounted, the mask 72 is put on the mounting protrusion 601 of the isolating cover 60, and then the mask 72 may be mounted on the isolating cover 60 by pressing, and locked with each other, in this way, such connection is convenient and reliable. Of course, the buckles may be further arranged on an inner wall of the mask 72 in a circumferential direction at interval, and a positioning clasp is arranged on the mounting protrusion 601 of the isolating cover 60 in a circumferential direction, so as to fix the mask 72 and the isolating cover 60 together. Alternatively, the mask 72 and the isolating cover 60 are fixed together by screws, pins or the like.

The lamp shell 70 is provided with a protective frame 73 for fixing the lamp shell 70 in a circumferential direction; specifically, the chassis 71 extends upward in the circumferential direction to form a chassis edge 711, and the chassis edge 711 is provided with a protective frame 73 in the circumferential direction; the protective frame 73 and the chassis 71 are fixed to each other by a buckle; a groove is arranged on an outer wall of the chassis 711 in the circumferential direction, a protrusion corresponding to the groove is arranged on the inner wall of the protective frame 73 in the circumferential direction, and when the protective frame 73 is engaged with the chassis edge 711, the protrusion is located in the groove, and such connection is convenient.

A mounting hanging plate 80 is arranged at a bottom of the chassis 71, and a storage cavity for accommodating the driving assembly 90, which is configured for driving the lighting device 500, is formed between the mounting hanging plate 80 and the chassis 71; the chassis 71 is provided with a plurality of strip-shaped screw mounting holes 712, the mounting hanging plate 80 is locked on the chassis 71 by screws 81 arranged in the screw mounting holes 712. The driving assembly is located in the storage cavity between the mounting hanging plate 80 and the chassis 71. The strip-shaped screw mounting holes 712 facilitates adjusting positions of the chassis 71 or the mounting hanging plate 80 while the screws 81 are mounted. The mounting hanging plate 80 is configured for mounting the lighting device 500 in required position, for example, on a wall, on a roof or on a piece of furniture, and such mounting is convenient. Of course, the chassis 71 and the mounting plate 80 may also be of an integral structure. As another example of the present disclosure, the driving assembly 90 may be arranged on the chassis 71, and located between the light source plate 51 and the chassis 71, or the driving assembly 90 may be integrated onto a bottom of the light source plate 51.

As another example of the present disclosure, the chassis 71 is provided with a strip-shaped screw mounting hole 712, the screw mounting hole 712 comprises a mounting section 713 for passing through a screw 81 and a locking section 714 for locking, a width of the mounting section 713 is greater than a width of the locking section 714, and the mounting hanging plate 80 is locked on the chassis 71 by a screw 81 arranged in the locking section 714 and a nut. The strip-shaped screw mounting holes 712 facilitates adjusting positions of the chassis 71 or the mounting hanging plate 80 while the screws 81 are mounted. And it is not necessary to remove the nut from the screw 81, the screw 81 may directly pass through the mounting section 713, and then the screw 81 is moved into the locking section 714, the nut may be tightened, and it is also not necessary to remove the nut during disassembly and maintenance, so that it is not easy to have a problem of losing parts or difficult assembly.

In the embodiment, the lamp shell 70 is a pentagonal star-shaped lamp shell. Specifically, the light source plate 51 is of pentagonal star-shaped, the isolating cover 60 is of pentagonal star-shaped, the lamp shell 70 is of pentagonal star-shaped, and the protective frame 73 is of pentagonal star-shaped; so that the lighting device is of pentagonal star-shaped, this special shape can increase interestingness of lighting, which is especially suitable for children's rooms. Of course, shapes of the light source plate 51, the isolating cover 60, and the middle region may also be a circle, or a square or an ellipse or other shapes.

A remote controller 100 is configured for controlling color of light emitted by a target lighting device, and the target lighting device of the embodiment is a lighting device 500, and may be another target lighting device, such as a desk lamp, a street lamp and so on.

The remote controller 100 comprises: a housing 10; a main control panel 20 of a remote control terminal, located in the housing 10 and provided with a color acquiring circuit 30 for acquiring color information of a target region, and a wireless transmitter for transmitting the color information to the target lighting device, and the target lighting device of the embodiment is the lighting device 500; and a color acquiring switch 47, located on the housing 10 and electrically connected with both the color acquiring circuit 30 and the wireless transmitter, and the color acquiring switch 47 is configured for turning on/off the color acquiring circuit 30 and the wireless transmitter. Pressing the color acquiring switch 47 may trigger the color acquiring circuit 30 to acquire color, so as to obtain color information, and the main control panel 20 of the remote control terminal calculates and processes the color information, and then the wireless transmitter transmits the color information to the lighting device 500, so that the lighting device 500 may acquire corresponding color information and emit light of the color. The remote controller 100 has simple structure and convenient operation, and may make the lighting device 500 emit light of a corresponding color according to customer requirements. Specifically, a driving power assembly 49 connected with the main control panel 20 of the remote control terminal is further arranged in the housing 10 for supplying power to the remote controller 100.

The main control panel 20 of the remote control terminal is further provided with a pairing unit of control part for pairing with the target lighting device; the pairing unit of control part may be a signal transmitter (not shown), and the signal transmitter is configured for transmitting signals to pair the remote controller 100 with the lighting device 500, and the lighting device 500 may be a table lamp, a street lamp, a wall lamp, a ceiling lamp, a lamp post or other forms of lamp. After pairing with the lighting device 500, the color acquiring circuit 47 is triggered by the color acquiring switch 47 to acquire color, so as to acquire color information, and then the color information is transmitted to the main control panel 20 of the remote control terminal. The main control panel 20 of the remote control terminal calculates and processes the received color information to obtain color information data, and transmit the color information data to the wireless transmitter. The wireless transmitter converts the color information data into radio signal (i.e., X, Y, Z values of color point information) for transmitting. When the radio signal is received by a wireless communication module (coupled with the wireless transmitter) on the lighting device, a color light emitting unit of the lighting device 500 may emit light of a corresponding color according to the received color point information.

The remote controller 100 is further provided with a pairing switch 46, and the pairing switch 46 is located on the housing 10 and electrically connected with the pairing unit of control part. The pairing switch 46 is configured for turning on/off the pairing unit of control part. While the pairing switch 46 is turned on, the pairing switch 46 triggers the signal transmitter to transmit a signal, so as to pair the remote controller 100 with the wireless communication module of the lighting device 500. The control is achieved through the pairing switch 46, so it is simple in operation and does not cause a pairing error.

The color acquiring switch 47 and the pairing switch 46 are fixed on the housing 10 by screws. The screw connection mode is simple in operation, and the connection is firm and located on the housing 10, which is convenient for an operator to operate. Of course, the color acquiring switch 47 and the pairing switch 46 may further be arranged on the housing 10 through a clamp structure, or may be adhered to the housing, which will not be repeated herein. The pairing switch 46 comprises a pairing circuit board 461, a pairing button and a pairing button cap 462, and the pairing button is arranged on the pairing circuit board 461. The color acquiring switch 47 comprises a color acquiring circuit board 471, a color acquiring button, and a color acquiring button cap 472, and the color acquiring button is located on the color acquiring circuit board 471. The pairing button cap 462 is configured for pressing the pairing button on the pairing circuit board 461, and the color acquiring button cap 472 is configured for pressing the color acquiring button on the color acquiring circuit board 471. The pairing circuit board 461 and the color acquiring circuit board 471 may be of a detachable structure, and the pairing circuit board 461 and the color acquiring circuit board 471 are arranged in a holding rod 40 respectively; the pairing circuit board 461 and the color acquiring circuit board 471 may further be of an integral structure, and the pairing circuit board 461 and the color acquiring circuit board 471 are integrated on a single circuit board, to form a circuit board of switch part 48, and the circuit board of switch part 48 is arranged in the housing 10, which makes structures of the pairing switch 46 and the color acquiring switch 47 simpler. The pairing button cap 462 and the color acquiring button cap 472 may be arranged along a vertical direction or along a horizontal direction, and preferably, the present disclosure adopts a manner of arranging the vertical direction. The pairing button cap 462 and the color acquiring button cap 472 may be made of a silicone material or a plastic material or a material same as that of the housing 10.

The color acquiring circuit 30 comprises a sensing element 31 and a light compensating element 32; the sensing element 31 is configured for sensing color information and transmitting the color information to the main control panel 20 of the remote control terminal. Specifically, the sensing element 31 may select different sensors, such as a color sensor or a spectrum detector, according to different applications in low-end, middle-end, or high-end products. The color sensor is mainly applied to the low-end or middle—end products, to detect color of surface of an object and convert the color into three primary color information. The spectrum detector is mainly applied to the high-end product, it may accurately detect an inverse spectrum of an object and provide more reliable information for the lamps to be lighted and outputting light. The acquired original color information is red (R), green (G), blue (B) or spectrum information of color. In the embodiment, the color sensor is configured for detecting color information of an object irradiated by light. The color sensor may be categorized into an RGB color sensor and an XYZ color sensor according to different outputs. The RGB color sensor is used in the embodiment, which corresponds to an RGB color model. The RGB color model is the most common color model, derived from visual tri-color theory, that is, all colors existing in nature may be synthesized by three colors of red (R), green (G) and blue (B). Therefore, color information output by the RGB color sensor is three color components of R, G, and B. When an operator holds the housing 10 of the remote controller 100 and faces an object with a surface original color, the color sensor of the color acquiring circuit 30 faces the object with the surface original color, which is not only convenient for the color acquiring circuit 30 to acquire color information but also convenient for the operator to use. In case that the object with the surface original color is a non-light-emitting object, light emitted by the light compensating element 32 may directly irradiate on the non-light-emitting object, and preferably, the light compensating component 32 is selected as a light source emitting white light. A condensing lens 33 corresponding to the color acquiring circuit 30 is arranged in the housing 10; the color sensor distinguishes colors by receiving light reflected from the object, and different positions of the same object may have different colors. In another example, in order to accurately measure colors, a converging condensing lens assembly may be arranged at a light entrance of the RGB color sensor, and the converging condensing lens assembly may be a convex lens, a Fresnel condensing lens or a combination of these condensing lens, so that the RGB color sensor only accepts incident light in a smaller range.

The housing 10 is provided with a color acquiring through hole 14 corresponding to the sensing element 31 and a light compensating through hole 13 corresponding to the light compensating element 32, the sensing element 31 faces the color acquiring through hole 14, and the light compensating element 32 faces the light compensating through hole 13. The light compensating through hole 13 facilitates the light emitted from the light compensating element to pass through and compensate for the environment where the color of the light is acquired; and the sensing through hole 14 facilitates the sensing element 31 to acquire color.

The housing 10 is provided with a groove 112 and a light-transmitting lens 15 covering the groove 112, and the light compensating through hole 13 and the color acquiring through hole 14 are located in the groove 112 respectively, and covered with the light-transmitting lens 15. Because the light compensating through hole 13 and the color acquiring through hole 14 are covered with the light-transmitting lens 15, they may be protected from dust and moisture, and a device in a head shell 101 may be effectively protected without affecting acquiring color by the sensing element 3 and compensating light by the light compensating element 32.

Figure 14:
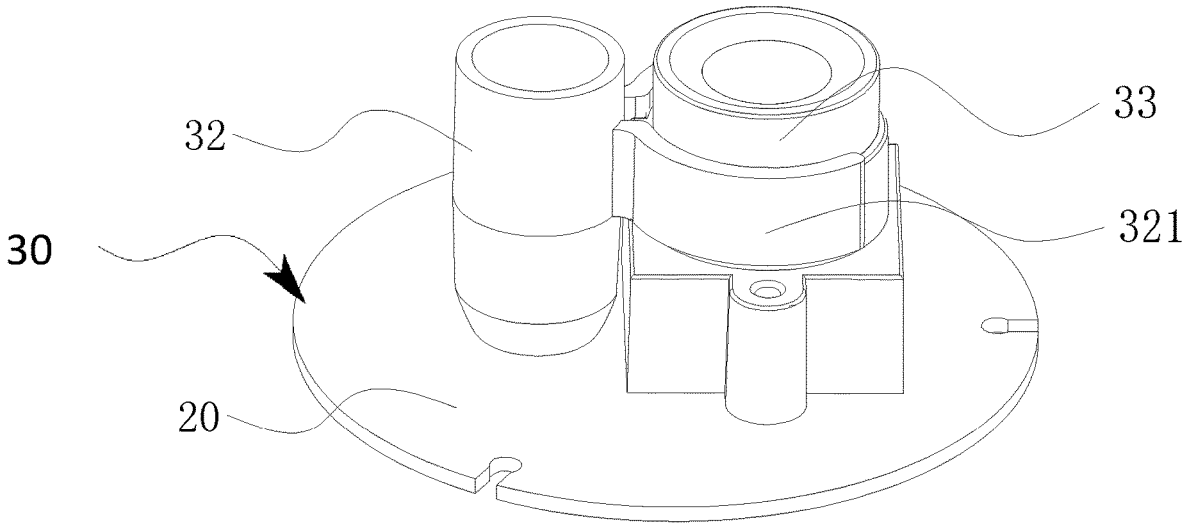
FIG. 14 is a schematic diagram of a main control panel and a color acquiring circuit in accordance with an example of the present disclosure.
Figure 15:
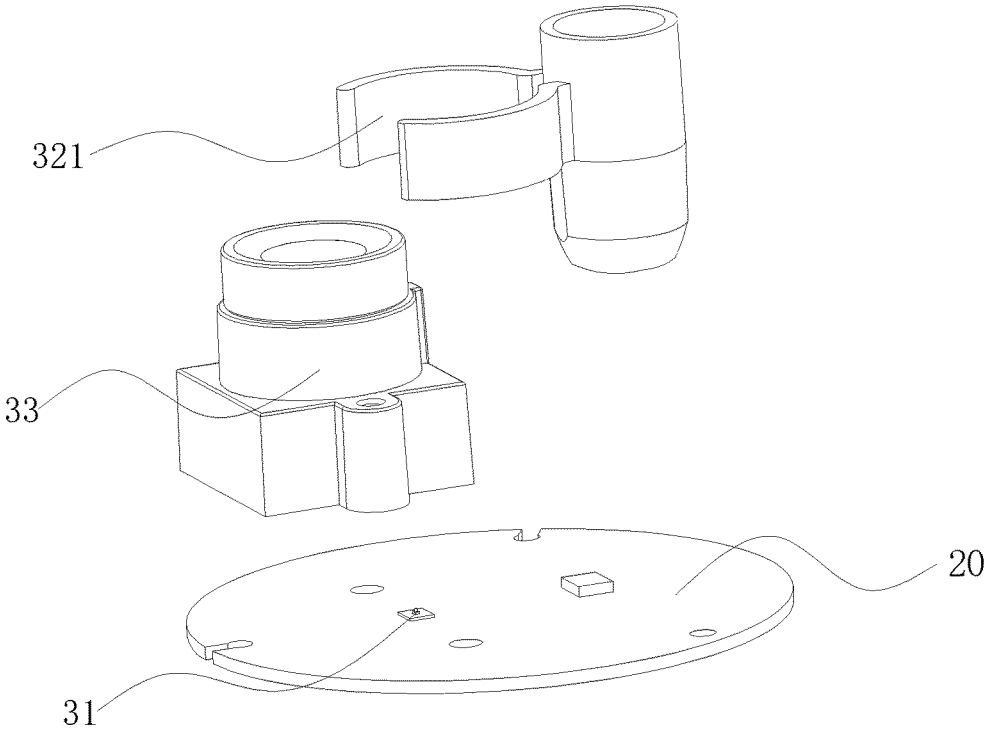
FIG. 15 is an exploded view of a main control panel and a color acquiring circuit in accordance with an example of the present disclosure.
Figure 16:
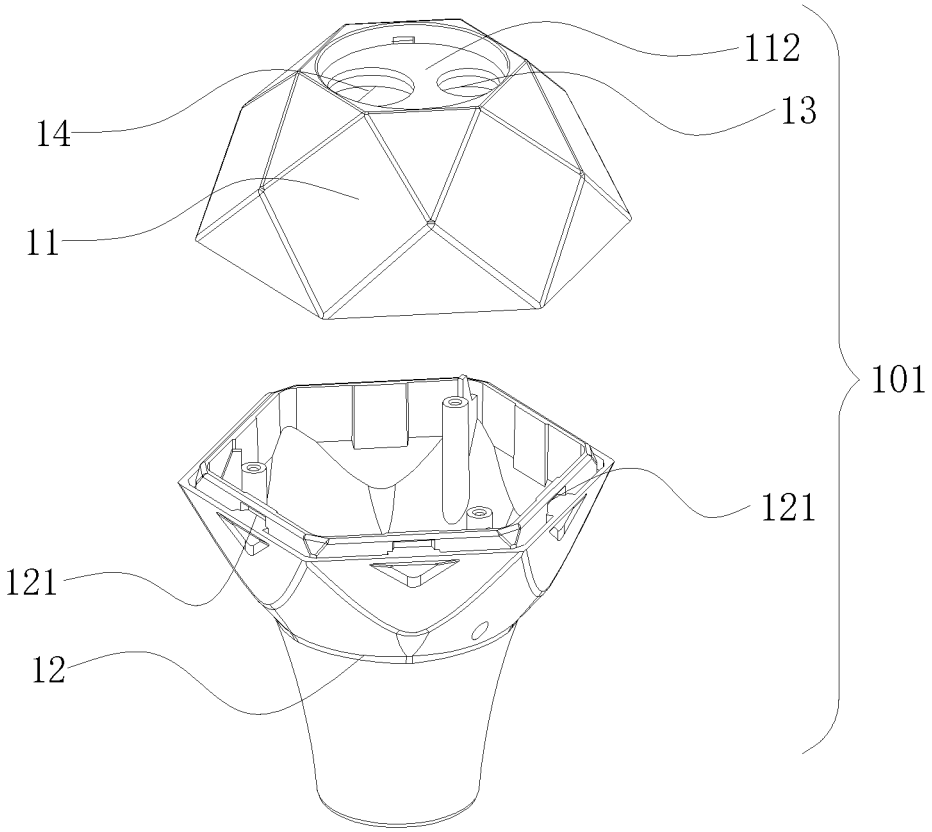
FIG. 16 is an exploded view of a head shell in one direction in accordance with an example of the present disclosure.
Figure 17:
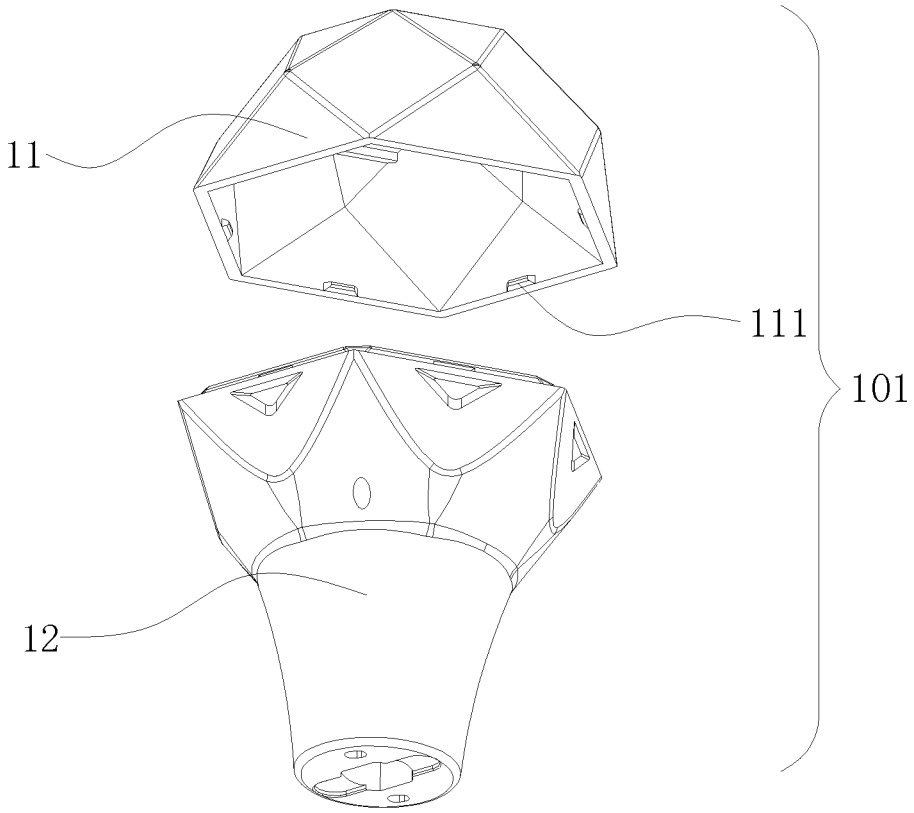
FIG. 17 is an exploded view of a head shell in another direction in accordance with an example of the present disclosure.
Figure 18:
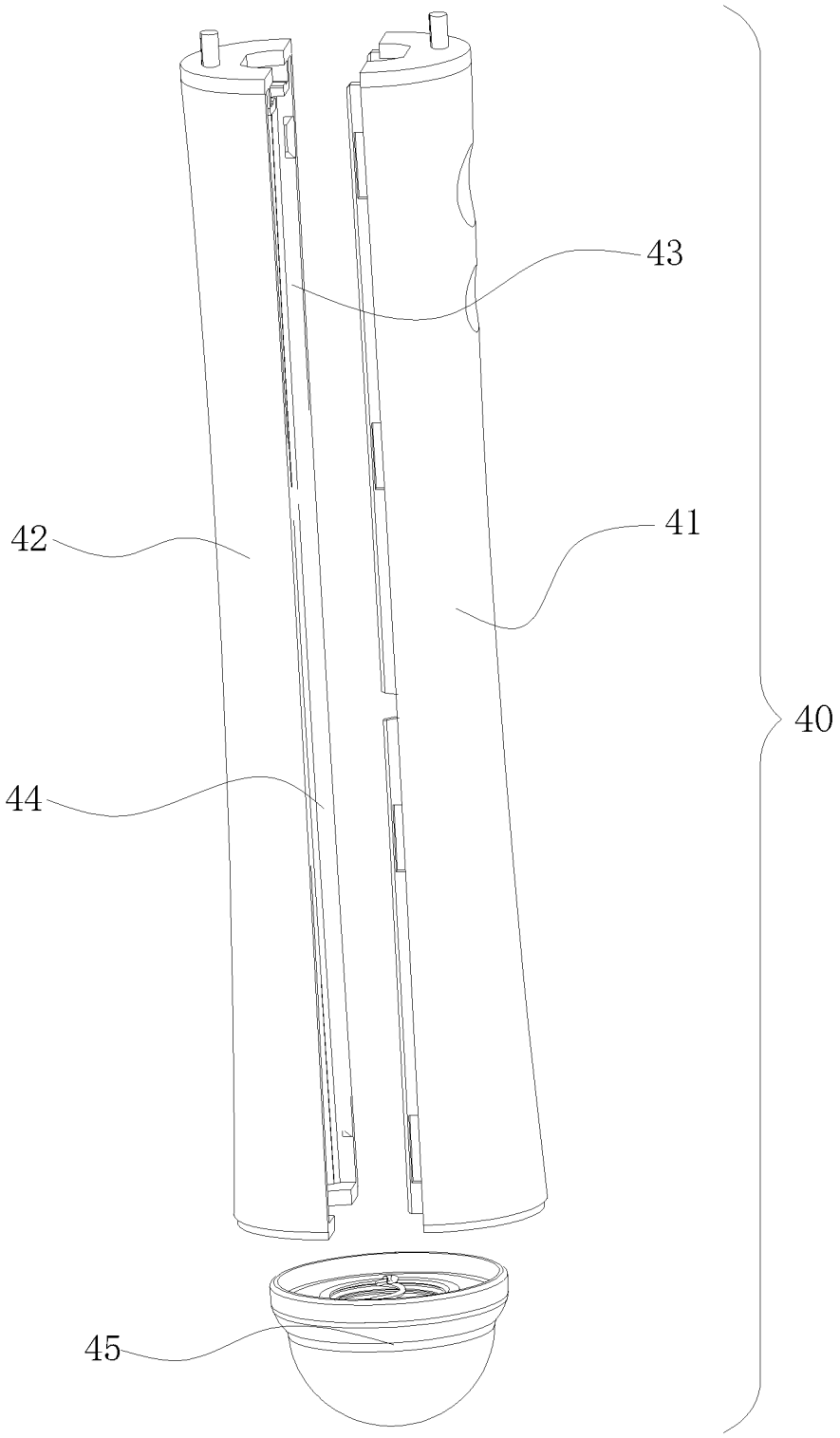
FIG. 18 is an exploded view of a holding rod in accordance with an example of the present disclosure.

FIG. 14 is a schematic diagram of a main control panel and a color acquiring circuit in accordance with an example. The light compensating element 32 is fixed on the condensing lens 33 by a clasp 321. The way of fixing by the clasp 321 has simple operation, and the connection is convenient and reliable.

The housing 10 comprises a head shell 101 and a holding rod 40 coupled with each other, the main control panel 20 of the remote control terminal is located in the head shell 10, and both the color acquiring switch 47 and the pairing switch 46 are located on the holding rod 40. The color acquiring switch 47 and the pairing switch 46 arranged on the holding rod 40 along an extending direction of the holding rod 40.

The head shell 101 comprises an upper cover 11 and a lower cover 12 connected with each other by a buckle, and the lower cover 12 and the holding rod 40 are connected and locked with each other by a fixing screw 122 and a nut 123. The upper cover 11 is provided with a light compensating through hole 13 corresponding to the light compensating element 32 and a color acquiring through hole 14 corresponding to the sensing element 31, the sensing element 31 faces the color acquiring through hole 14, and the light compensating element 32 faces the light compensating through hole 13. The upper cover 11 and the lower cover 12 may be transparent or opaque, and the lower cover 12 and the upper cover 11 may be connected with each other by buckling, screw locking, bonding, or the lower cover 12 and the upper cover 11 may be formed integrally. Buckling connection is preferably adopted in the present disclosure. Buckles 111 are arranged on an opening of the upper cover 11 in a circumferential direction, and the buckles 111 are located on an inner wall of the upper cover 11. Buckle mouths 121 corresponding to the buckles 111 are arranged on an opening of the lower cover in a circumferential direction, and the buckle mouths 121 are located on an outer wall of the lower cover. While the upper cover 11 and the lower cover 12 are fastened to each other, the buckles 111 are located in the corresponding buckle mouth 121, to lock the upper cover 11 and the lower cover 12, which is convenient to mount and connected securely. Of course, it is also possible that the buckles are located on the lower cover 12, and the buckle mouths are located on the upper cover 11. The head shell 101 may be a 3D polygon, a pentagonal star, a flower shape, a crown shape, or other shapes. The shape is peculiar, so as to meet requirements of different groups of people. The present disclosure adopts a regular polygon, and the remote controller 100 further comprises an ornament 16 arranged on the fixing screw 122, and the crown-shaped ornament 16 is sleeved on the screw 122 at an intersection of the lower cover 12 and the holding rod 40, so that the remote controller 100 is more beautiful.

The remote controller 100 further comprises a power storage cavity 44 in the housing 10 and a cover 45 for opening and closing the power storage cavity 44. Specifically, the holding rod 40 comprises a front cover 41 and a rear cover 42 connected with each other by a buckle; the front cover 41 and the rear cover 42 are locked by a buckle to form a storage cavity, and the storage cavity comprises a switch storage cavity 43 for accommodating switches and a power storage cavity 44 for accommodating power source; the pairing switch 46 and the color acquiring switch 47 are arranged in the switch storage cavity 43, and the driving power assembly 49 is arranged in the power storage cavity 44. The driving power source component 49 comprises a battery box 491 arranged in the holding rod 40 and a battery 492 arranged in the battery box 491. The driving power assembly 49 may be direct current or alternating current, and may be a fixed or mobile power source, and preferably, a mobile lithium battery is used as a driving power source, which may be repeatedly charged, thereby not only saving using cost of the color acquiring remote controller, but also reducing battery consumption, so as to reduce environmental pollution caused by waste batteries. Specifically, the battery box 491 is fixed in the power storage cavity 44, and the batteries 492 are placed in the battery box 491 by passing through a battery mounting hole at a bottom end of the holding rod 40, and then covered by the cover 45. Of course, the batteries 492 may be mounted in the battery box 491, and then the battery box 491 is placed into the power storage cavity 44 of the holding rod 40 by passing through the battery mounting hole at a bottom end of the holding rod 40, and finally the cover 45 is placed over the battery mounting hole at the bottom end of the holding rod 40.

The isolating cover 30 of the lighting device 500 of the present disclosure separate the light source plate 51 into a first cavity and a second cavity, and a white light emitting unit is located in the first cavity, and a colored light emitting unit is located in the second cavity, so that the white light emitting unit and the colored light emitting unit are independent units, and when they emit light, no interference is occurred therebetween. The white light emitting unit and the colored light emitting unit are integrated on the light source plate 51, so that the lighting device 500 has a simple and compact structure and may emit white light, or the lighting device 500 may emit colored light which is acquired and transmitted by the remote controller 100; the mounting hanging plate 50 is convenient to mount the lighting device 500, and the lighting device 500 may be mounted on a wall or a top plate, which is convenient; specifically, the remote controller 100 triggers a signal transmitter through the pairing switch 46 to transmit a signal; after a wireless communication module of the lighting device 500 receives the signal, the remote controller 100 may be paired with the lighting device 500; after the remote controller 100 and the lighting device 500 are paired, the light acquiring switch 46 of the remote controller 100 triggers the light compensating element 32 to compensate light, and meanwhile the color sensor acquires color and transmits the color information to the main control panel 20 of the remote control terminal; the main control panel 20 of the remote control terminal calculates and processes the color information, and then the color information is transmitted by the wireless transmitter; after receiving the color information, a wireless communication module of the lighting device 500 transmits the color information to a main control panel of a lighting terminal; the main control panel of a lighting terminal controls a colored light emitting unit of the lighting device 500 to emit light of the color. The remote controller 100 has a simple structure, and may make a lamp emit light of a corresponding color according to customer requirements. Moreover, the control of the remote controller 100 can be operated simple, and the pentagonal star-shaped lighting device has a peculiar shape, which increases interestingness of lighting, especially suitable for children's rooms.

Alternatively or additionally, the main control panel of the remote control terminal is further provided with a pairing unit of a control part for pairing the wireless transmitter with the target lighting device.

Alternatively or additionally, the remote controller is further provided with a pairing switch, the pairing switch is located on the housing and electrically connected with the pairing unit of the control part, and the pairing switch is configured for turning on/off the pairing unit of the control part.

Alternatively or additionally, the color acquiring switch comprises a color acquiring circuit board, a color acquiring button and a color acquiring button cap, the pairing switch comprises a pairing circuit board, a pairing button and a pairing button cap, a color acquiring button slot and a pairing button slot are arranged on the housing respectively, and the color acquiring button cap and the pairing button cap are exposed from the color acquiring button slot and the pairing button slot, respectively.

Alternatively or additionally, the color acquiring circuit board and the pairing circuit board are of an integral structure.

Alternatively or additionally, the color acquiring circuit comprises a sensing element and a light compensating element.

Alternatively or additionally, the housing is provided with a light compensating through hole corresponding to the light compensating element and a color acquiring through hole corresponding to the sensing element, the sensing element faces the color acquiring through hole, and the light compensating element faces the light compensating through hole; and the housing is provided with a groove, the light compensating through hole and the color acquiring through hole are located in the groove respectively, the light compensating through hole and the color acquiring through hole are covered with a light-transmitting lens, and the light-transmitting lens is located in the groove.

Alternatively or additionally, a condensing lens covering on the color acquiring circuit is arranged in the housing.

Alternatively or additionally, the housing comprises a head shell and a holding rod connected with each other, the main control panel of the remote control terminal is located in the head shell, both the color acquiring switch and the pairing switch is located on the holding rod, and the color acquiring switch and the pairing switch are arranged on the holding rod along an extending direction of the holding rod.

Alternatively or additionally, the remote controller further comprises a power storage cavity in the housing and a cover configured for opening and closing the power storage cavity.

Alternatively or additionally, the light source assembly comprises: a light source plate; a light emitting unit set, comprising a first color light emitting unit and a second color light emitting unit arranged on the light source plate; a main control panel of a lighting terminal, electrically connected with the light source plate, and configured for controlling at least one of the first color light emitting unit and the second color light emitting unit to emit light, and a wireless communication module configured for receiving a wireless signal being arranged thereon; and an isolating cover, located between the first color light emitting unit and the second color light emitting unit, and configured for separating the first color light emitting unit and the second color light emitting unit into different optical cavities.

Alternatively or additionally, the main control panel of the lighting terminal is provided with a receiver for receiving color information, and the main control panel of the lighting terminal controls the at least one of the first color light emitting unit and the second color light emitting unit to emit light in line with the color information.

Alternatively or additionally, the first color light emitting unit is a white light emitting unit, and the second color light emitting unit is a colored light emitting unit.

Alternatively or additionally, the light source assembly comprises a first protective cover covering the first color light emitting unit and a second protective cover covering the second color light emitting unit.

Alternatively or additionally, the second color light emitting unit is arranged on a periphery of the first color light emitting unit.

Alternatively or additionally, the isolating cover comprises an isolation connecting part coupled with the light source plate and a light distributing part connected with the isolation connecting part, and the light distributing part is configured for diffusing the light emitted by the second color light emitting unit to the periphery.

Alternatively or additionally, the first color light emitting unit and the second color light emitting unit are both light-emitting diode (LED) light emitting units.

Alternatively or additionally, the lamp shell comprises a chassis, and the light source plate is locked on the chassis by a locking device.

Alternatively or additionally, the lamp shell further comprises a mask covering the light source assembly, and the first color light emitting unit and the second color light emitting unit face the mask, respectively.

Alternatively or additionally, a mounting hanging plate is arranged at a bottom of the chassis, a storage cavity is formed between the mounting hanging plate and the chassis, and the driving assembly is located in the storage cavity.

Alternatively or additionally, the driving assembly is arranged on the chassis and between the light source plate and the chassis.

Alternatively or additionally, the chassis is provided with a plurality of strip-shaped screw mounting holes, and the mounting hanging plate is locked on the chassis by screws arranged in the screw mounting holes.

Alternatively or additionally, the chassis is provided with a strip-shaped screw mounting hole, the screw mounting hole comprises a mounting section for passing through a screw and a locking section for locking, a width of the mounting section is greater than a width of the locking section, and the mounting hanging plate is locked on the chassis by a screw arranged in the locking section and a nut.

The purposes, technical solutions and advantages of the present disclosure have been described in detail by the specific implementation modes herein, and it should be understood that, the above are merely specific embodiments of the present disclosure, and cannot limit the present disclosure. Any modifications, equivalent substitutions, improvements and the like made within the spirit and scope of the invention are intended to be included within the scope of the invention.

The invention claimed is:

1. A remote controller, for controlling color of light emitted by a target lighting device, comprising:

a housing;

a main control panel of a remote control terminal, at least partially disposed in the housing and provided with a color acquiring circuit and a wireless transmitter, wherein the color acquiring circuit is configured to acquire color information of a target region, and the wireless transmitter is configured to transmit the color information to the target lighting device; and a color acquiring switch, located on the housing and electrically connected with both the color acquiring circuit and the wireless transmitter, wherein the color acquiring switch is configured to control the color acquiring circuit and the wireless transmitter.

2. The remote controller according to claim 1, wherein the main control panel of the remote control terminal is further provided with a pairing unit of a control part for pairing the wireless transmitter with the target lighting device.

3. The remote controller according to claim 2, wherein the remote controller is further provided with a pairing switch, the pairing switch being located on the housing and electrically connected with the pairing unit of the control part, and the pairing switch being configured for turning on/off the pairing unit of the control part.

4. The remote controller according to claim 1, wherein the color acquiring switch comprises a color acquiring circuit board, a color acquiring button and a color acquiring button cap, and the pairing switch comprises a pairing circuit board, a pairing button and a pairing button cap, a color acquiring button slot and a pairing button slot being arranged on the housing respectively, and the color acquiring button cap and the pairing button cap being exposed from the color acquiring button slot and the pairing button slot, respectively.

5. The remote controller according to claim 4, wherein the color acquiring circuit board and the pairing circuit board are of an integral structure.

6. The remote controller according to claim 1, wherein the color acquiring circuit comprises a sensing element and a light compensating element.

7. The remote controller according to claim 6, wherein the housing is provided with a light compensating through hole corresponding to the light compensating element and a color acquiring through hole corresponding to the sensing element, the sensing element facing the color acquiring through hole, and the light compensating element facing the light compensating through hole;

the housing is provided with a groove, the light compensating through hole and the color acquiring through hole being located in the groove respectively, the light compensating through hole and the color acquiring through hole being covered with a light-transmitting lens, and the light-transmitting lens being located in the groove.

8. The remote controller according to claim 7, wherein a condensing lens covering the color acquiring circuit is arranged in the housing.

9. The remote controller according to claim 3, wherein the housing comprises a head shell and a holding rod connected with each other, the main control panel of the remote control terminal being located in the head shell, both the color acquiring switch and the pairing switch being located on the holding rod, and the color acquiring switch and the pairing switch being arranged on the holding rod along an extending direction of the holding rod.

10. The remote controller according to claim 1, wherein the remote controller further comprises a power storage cavity in the housing and a cover configured for opening and closing the power storage cavity.

11. Alighting system, comprising:

a remote controller comprising: a housing; a main control panel of a remote control terminal, at least partially disposed in the housing and provided with a color acquiring circuit and a wireless transmitter, wherein the color acquiring circuit is configured to acquire color information of a target region, and the wireless transmitter is configured to transmit the color information to the target lighting device; and a color acquiring switch, located on the housing and electrically connected with both the color acquiring circuit and the wireless transmitter, wherein the color acquiring switch is configured to control the color acquiring circuit and the wireless transmitter; and a lighting device configured to control color of light emitted by a light source assembly in accordance with the color information.

12. The lighting system according to claim 11, wherein the light source assembly comprises:

a light source plate;

a light emitting unit set, comprising a first color light emitting unit and a second color light emitting unit arranged on the light source plate;

a main control panel of a lighting terminal, electrically connected with the light source plate and configured for controlling at least one of the first color light emitting unit and the second color light emitting unit to emit light, and a wireless communication module configured for receiving a wireless signal being arranged thereon;

an isolating cover, located between the first color light emitting unit and the second color light emitting unit and configured for separating the first color light emitting unit and the second color light emitting unit into different optical cavities.

13. The lighting system according to claim 12, wherein the main control panel of the lighting terminal is provided with a receiver for receiving color information, the main control panel of the lighting terminal controlling the at least one of the first color light emitting unit and the second color light emitting unit to emit light in line with the color information.

14. The lighting system according to claim 12, wherein the first color light emitting unit is a white light emitting unit, and the second color light emitting unit is a colored light emitting unit.

15. The lighting system according to claim 12, wherein the light source assembly comprises a first protective cover covering the first color light emitting unit and a second protective cover covering the second color light emitting unit.

16. The lighting system according to claim 12, wherein the second color light emitting unit is arranged on a periphery of the first color light emitting unit.

17. The lighting system according to claim 16, wherein the isolating cover comprises an isolation connecting part coupled with the light source plate and a light distributing part connected with the isolation connecting part, the light distributing part being configured for diffusing light emitted by the second color light emitting unit to the periphery.

18. The lighting system according to claim 12, wherein the first color light emitting unit and the second color light emitting unit are both light-emitting diode (LED) light emitting units.

19. The lighting system according to claim 11, wherein the lamp shell comprises a chassis, the light source plate being locked on the chassis by a locking device.

20. The lighting system according to claim 19, wherein the lamp shell further comprises a mask covering the light source assembly, the first color light emitting unit and the second color light emitting unit facing the mask, respectively.

21. The lighting system according to claim 20, wherein a mounting hanging plate is arranged at a bottom of the chassis, a storage cavity being formed between the mounting hanging plate and the chassis, and the driving assembly being located in the storage cavity.

22. The lighting system according to claim 19, wherein the driving assembly is arranged on the chassis and between the light source plate and the chassis.

23. The lighting system according to claim 21, wherein the chassis is provided with a plurality of strip-shaped screw mounting holes, the mounting hanging plate being locked on the chassis by screws arranged in the screw mounting holes.

24. The lighting system according to claim 21, wherein the chassis is provided with a strip-shaped screw mounting hole, the screw mounting hole comprising a mounting section for passing through a screw and a locking section for locking, a width of the mounting section being greater than a width of the locking section, and the mounting hanging plate being locked on the chassis by a screw arranged in the locking section and a nut.

* * * * *